US010470527B2

(12) United States Patent
Hung

(10) Patent No.: US 10,470,527 B2
(45) Date of Patent: Nov. 12, 2019

(54) ROPE TAIL POSITIONING FASTENER

(71) Applicant: NIFCO TAIWAN CORPORATION, Taipei (TW)

(72) Inventor: Chun-Wei Hung, Taipei (TW)

(73) Assignee: NIFCO TAIWAN CORPORATION, Taipei (TW)

( * ) Notice: Subject to any disclaimer, the term of this patent is extended or adjusted under 35 U.S.C. 154(b) by 0 days.

(21) Appl. No.: 15/891,694

(22) Filed: Feb. 8, 2018

(65) Prior Publication Data

US 2018/0235323 A1 Aug. 23, 2018

(30) Foreign Application Priority Data

Feb. 20, 2017 (TW) ..... 106202431 U

(51) Int. Cl.

| | |
|---|---|
| ***A44B 11/06*** | (2006.01) |
| ***A44B 11/20*** | (2006.01) |
| ***A44B 11/28*** | (2006.01) |
| ***A43C 7/00*** | (2006.01) |

(52) U.S. Cl.

CPC ..... *A44B 11/065* (2013.01); *A43C 7/00* (2013.01); *A44B 11/20* (2013.01); *A44B 11/28* (2013.01)

(58) Field of Classification Search

CPC ..... A44B 11/065; A44B 11/20; A44B 11/28; A43C 7/00

See application file for complete search history.

(56) References Cited

U.S. PATENT DOCUMENTS

| | | | | |
|---|---|---|---|---|
| 1,957,274 A * | 5/1934 | Lederer | A44C 5/2071 | 224/172 |
| 2,041,354 A * | 5/1936 | Kestenman | A44C 5/185 | 24/265 WS |
| 3,074,135 A * | 1/1963 | Brodowski | A43C 7/00 | 24/115 G |
| 8,695,170 B2 * | 4/2014 | Honeycutt | A44C 15/003 | 24/3.1 |
| 10,149,514 B2 * | 12/2018 | Adams | A43C 1/06 | |

* cited by examiner

*Primary Examiner* — Robert Sandy
*Assistant Examiner* — Louis A Mercado
(74) *Attorney, Agent, or Firm* — Muncy, Geissler, Olds & Lowe, P.C.

(57) ABSTRACT

The present disclosure illustrates a rope tail positioning fastener including a fastener body. The fastener body includes a base and an elastic arm, and the base has an insertion channel inside, and the insertion channel is provided with two through holes at a side thereof and a hole at other side thereof, and a stop part is formed between the two through holes, and a side of the base adjacent to the hole is bent to form the elastic arm suspended relative to the base, so that two tail parts of the rope can be inserted into, through and out of the insertion channel via the through holes; next, the two tail parts of the rope can be sewn to form a seam part; and, after the seam part is completed, the user can pull the rope back to receive the two tail parts inside the insertion channel.

3 Claims, 7 Drawing Sheets

ROPE TAIL POSITIONING FASTENER

This application claims the priority benefit of Taiwan patent application number 106202431, filed on Feb. 20, 2017.

BACKGROUND OF THE INVENTION

1. Field of the Invention

The present disclosure relates to a rope tail positioning fastener, more particularly to a rope tail positioning fastener including a base which is provided with an insertion channel inside, and the insertion channel is provided with two through holes, and two tail parts of a rope can be inserted into the two through holes; and, after the two tail parts are inserted out of a hole at other side of the insertion channel, a seam part can be formed on the two tail parts of the rope to combine the two tail parts, and the seam part can be stopped by a stop part between the two through holes. The two tail parts of the rope are combined by the seam manner, so that the entire size of the fastener can be reduced.

2. Description of the Related Art

Nowadays, the fasteners are widely applied in many fields, and different types of fasteners have different fastening manners, so that the fasteners can be applicable to many articles, such as backpack, shoe or garment. In use, a rope is usually inserted through the fastener, and two end heads of the rope are inserted out of the fastener, and other fastener is then mounted on the two head parts, so that the user can slide the fastener along the rope to adjust a size of the opening of the article, such as backpack, shoe or garment.

Furthermore, on a general article, a zipper slider of a zipper or a cord lock used for two ends of a rope is usually fastened by a hollow plastic member, and tail parts of the two ends of the rope are inserted into, through and then out of a hollow channel inside the plastic member, and the exposed tail parts are knotted to form a stop structure, thereby preventing the rope from departing from the hollow plastic member. However, the knot exposed out of the surface of the article looks abrupt and not beautiful, and when the user pulls the rope or the zipper, the user may easily touch the knot and feel uncomfortable.

Therefore, a solution is developed to use a cord lock to directly fasten the tail parts of the two ends of the rope, and then use a tooth engagement manner to fix the cord lock, so that the cord lock and the rope can be assembled easily and the tail parts of the two ends of the rope are not exposed out of the cord lock. However, when the user pulls the rope or the rope is pulled by an external force, the rope is easy to depart from the cord lock because of the insufficient strength of tooth engagement. Furthermore, a conventional cord lock is developed to solve above-mentioned problem, and the conventional cord lock has a hollow base which defines a receiving groove inside, and the receiving groove is provided with through holes respectively at two opposite sides thereof, and the base is formed with a hole cut through a bottom surface thereof and in communication with the receiving groove. Two tail parts of a rope can be inserted into the two through holes, through the receiving groove, and then out of the hole, and after the two tail parts of the rope is knotted outside of the cord lock, the knot can be received in the receiving groove. In order to receive the knot in the receiving groove, the cord lock must has a larger volume, and it increases the material cost of the cord lock; furthermore, the larger-size cord lock also look less beautiful.

SUMMARY OF THE INVENTION

In order to solve above-mentioned problems, the inventor develops a rope tail positioning fastener according to collected data, multiple tests and modifications, and years of experience.

An objective of the present disclosure is to provide a rope tail positioning fastener including a fastener body, and a base of a fastener body is provided with an insertion channel inside, and the insertion channel is provided with two through holes cut through a side thereof and a hole cut through other side thereof, and a stop part is formed between the two through holes, and a side of the base adjacent to the hole is bent and extended to form an elastic arm suspended relative to the base, so that two tail parts of the rope can be inserted into the insertion channel via the through holes of the base, and then out of the hole at other side of the insertion channel; next, the two tail parts of the rope can be sewn to form a seam part; and, after the seam part is completed, the user can pull the rope back to receive the two tail parts of the rope inside the insertion channel of the base, thereby making the combination of the fastener and the rope tails appear aesthetically appealing and fashionable; furthermore, the two tail parts of the rope is combined by seam line, so that the fastener body can have a smaller size, and the material cost of the fastener body can be reduced, thereby making the fastener more competitive.

An objective of the present disclosure is that the base has clamping blocks respectively protruded on inside walls of two opposite sides of the insertion channel thereof, and when the rope is received in the insertion channel, the rope can be clamped by the two clamping blocks, so that the rope can be reliably positioned inside the insertion channel without being exposed out of the insertion channel; as a result, while the user is walking or doing exercise, the tail parts of the rope is hard to slip out of the insertion channel to swing freely, thereby preventing the user from stumble or accident due to the rope being stepped by the user or hooked by other object, and further ensuring the user's safety.

BRIEF DESCRIPTION OF THE DRAWINGS

The structure, operating principle and effects of the present disclosure will be described in detail by way of various embodiments which are illustrated in the accompanying drawings.

DETAILED DESCRIPTION OF THE PREFERRED EMBODIMENTS

Figure 1:
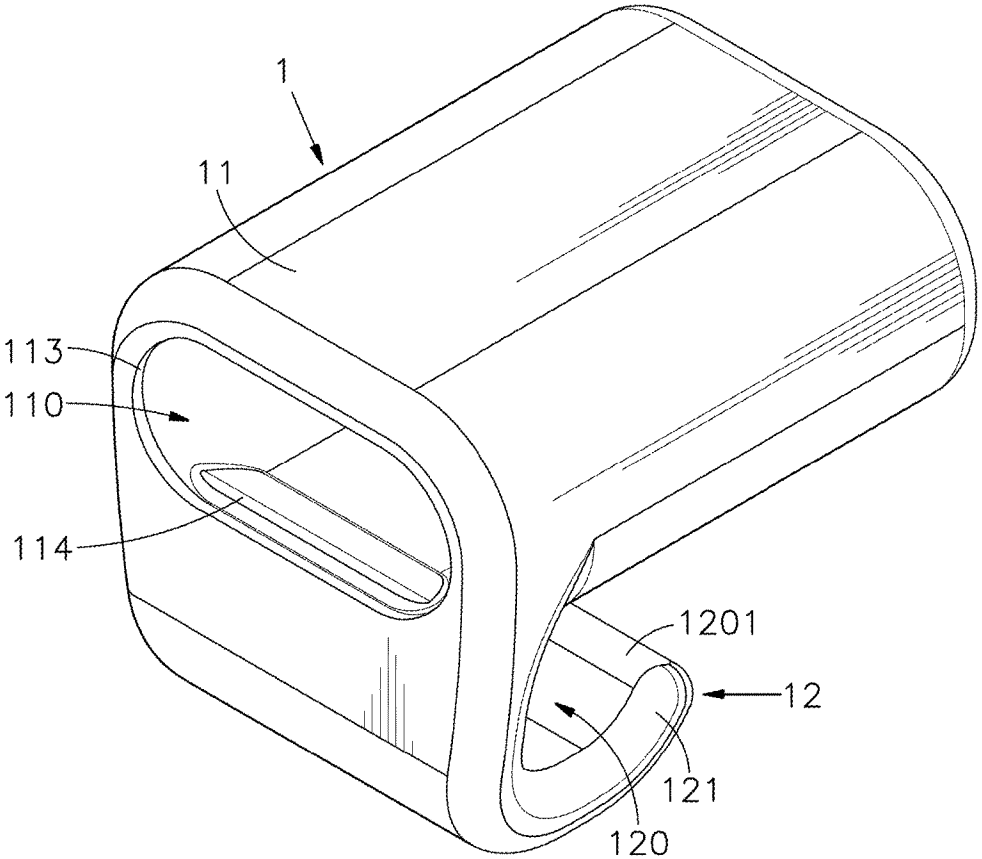
FIG. 1 is an elevational view of an embodiment of the present disclosure.

The following embodiments of the present disclosure are herein described in detail with reference to the accompanying drawings. These drawings show specific examples of the embodiments of the present disclosure. It is to be understood that these embodiments are exemplary implementations and are not to be construed as limiting the scope of the present disclosure in any way. Further modifications to the disclosed embodiments, as well as other embodiments, are also included within the scope of the appended claims. These embodiments are provided so that this disclosure is thorough and complete, and fully conveys the inventive concept to those skilled in the art. Regarding the drawings, the relative proportions and ratios of elements in the drawings may be exaggerated or diminished in size for the sake of clarity and convenience. Such arbitrary proportions are only illustrative and not limiting in any way. The same reference numbers are used in the drawings and description to refer to the same or like parts.

It is to be understood that, although the terms 'first', 'second', 'third', and so on, may be used herein to describe various elements, these elements should not be limited by these terms. These terms are used only for the purpose of distinguishing one component from another component. Thus, a first element discussed herein could be termed a second element without altering the description of the present disclosure. As used herein, the term "or" includes any and all combinations of one or more of the associated listed items.

Figure 2:
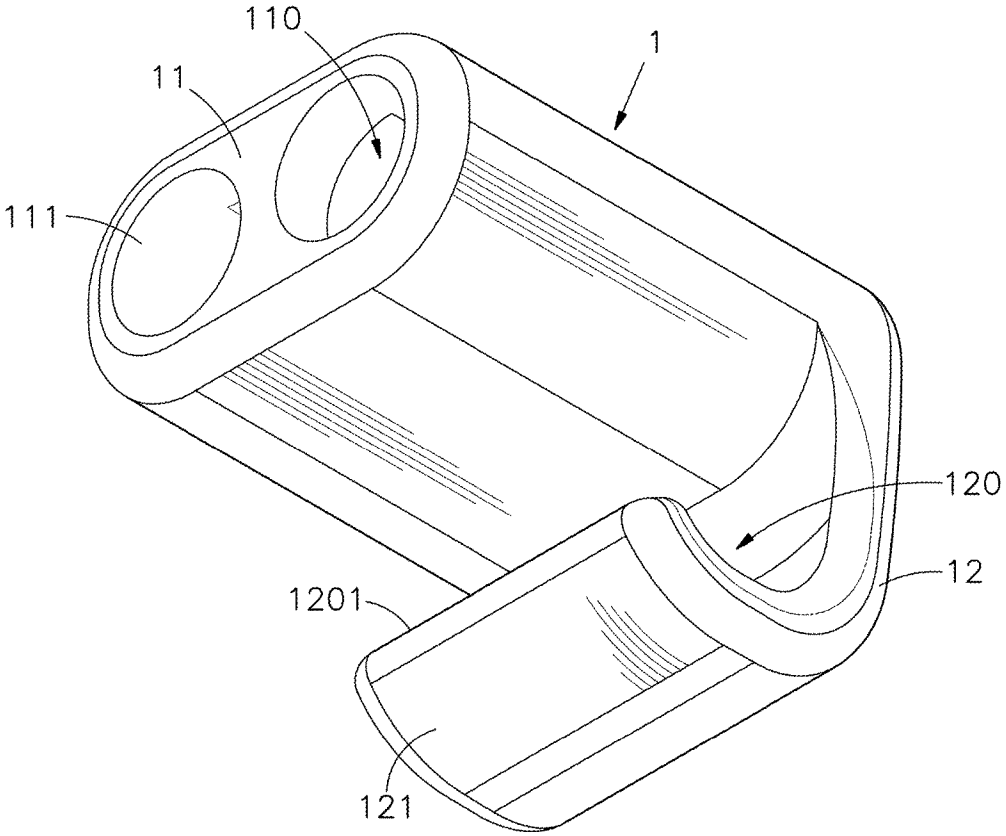
FIG. 2 is an elevational view of an embodiment of the present disclosure, when viewed from another angle.
Figure 3:
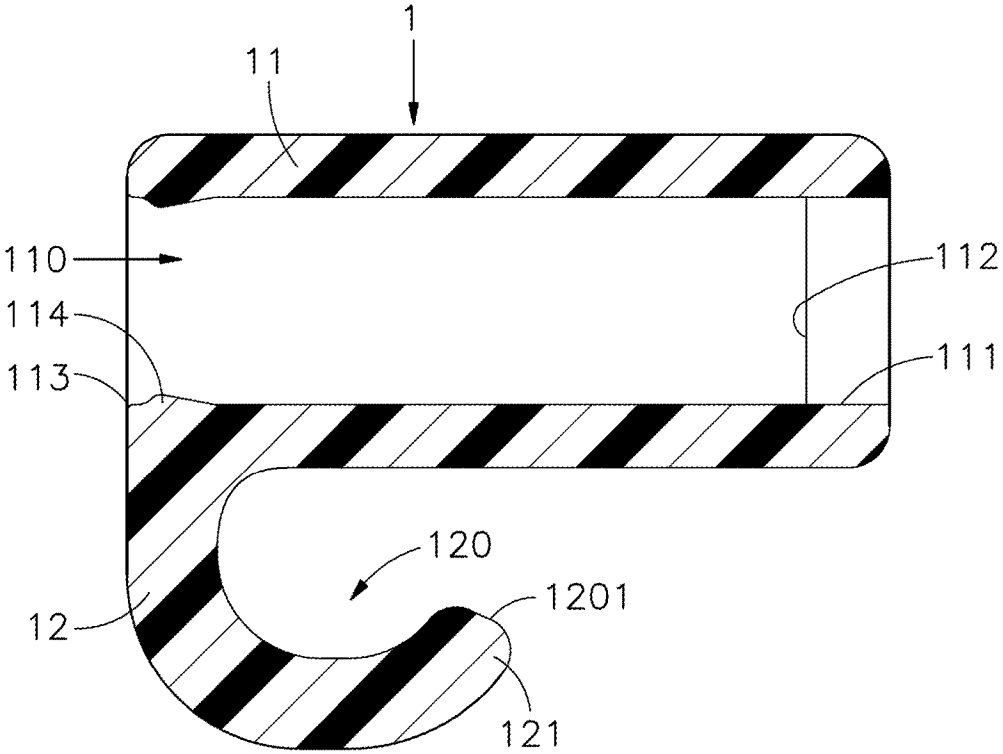
FIG. 3 is a sectional side view of an embodiment of the present disclosure.

Please refer to FIGS. 1, 2 and 3, which are elevational view of an embodiment of the present disclosure, and elevational view and sectional side view of the embodiment of the present disclosure when viewed from another angle. A fastener body 1 includes a base 11 and an elastic arm 12, and the base 11 is made integrally by elastic material such as rubber or plastic. A side of the fastener body 1 is bent to from the elastic arm 12 suspended relative to the base 11. The following describes the main component and features of the fastener of the present disclosure.

The base 11 of the fastener body 1 is provided with an insertion channel 110 formed therein, and the insertion channel 110 is formed with two through holes 111 cut through a side thereof, and a stop part 112 disposed between the two through holes 111. The insertion channel 110 is further provided with a hole 113 cut therethrough other side thereof, and two clamping blocks 114 protruded on two inside walls of two opposite sides thereof and adjacent to a side of the hole 113. The elastic arm 12 is extended and bent from a side of the base 11 adjacent to the hole 113, and suspended relative to the base 11, and the elastic arm 12 is provided with a hook part 121 formed at an end portion thereof and facing towards the base 11. A receiving space 120 is formed between an inner side of the elastic arm 12 and the base 11, and an opening 1201 is formed between an end portion of the hook part 121 and the base 11. A distance between the hook part 121 and the base 11 (that is, a size of the opening 1201) is shorter than an outer diameter of a rope 2.

Figure 4:
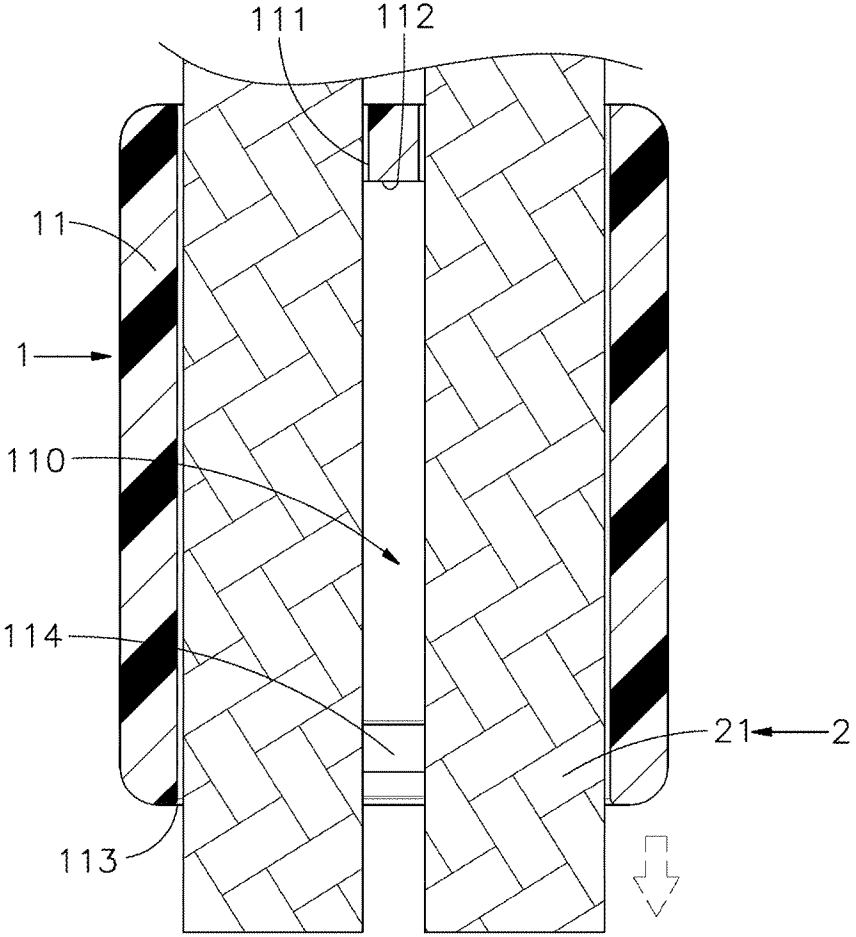
FIG. 4 is a first sectional side view of a fastener assembled with a rope, in accordance with the present disclosure.
Figure 5:
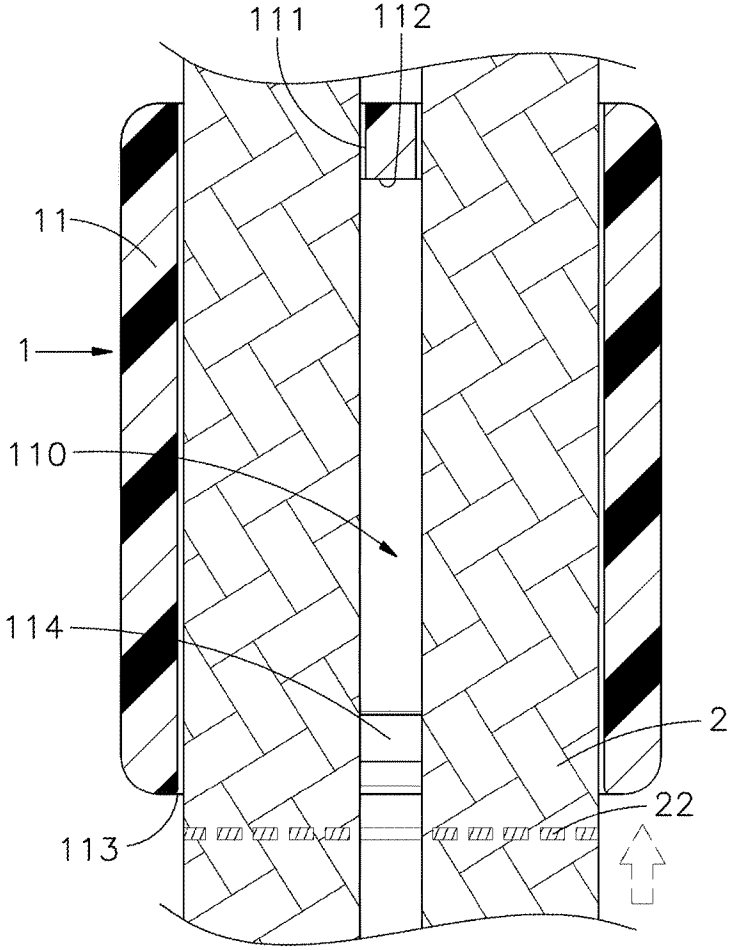
FIG. 5 is a second sectional side view of the fastener assembled with the rope, in accordance with the present disclosure.
Figure 6:
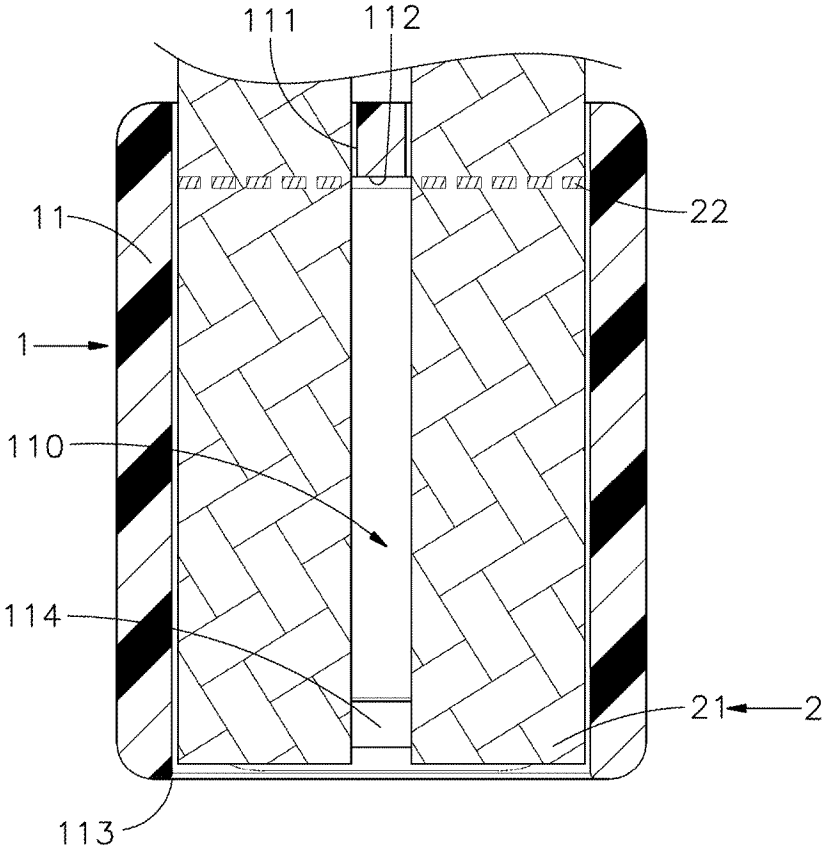
FIG. 6 is a third sectional side view of the fastener assembled with the rope, in accordance with the present disclosure.
Figure 7:
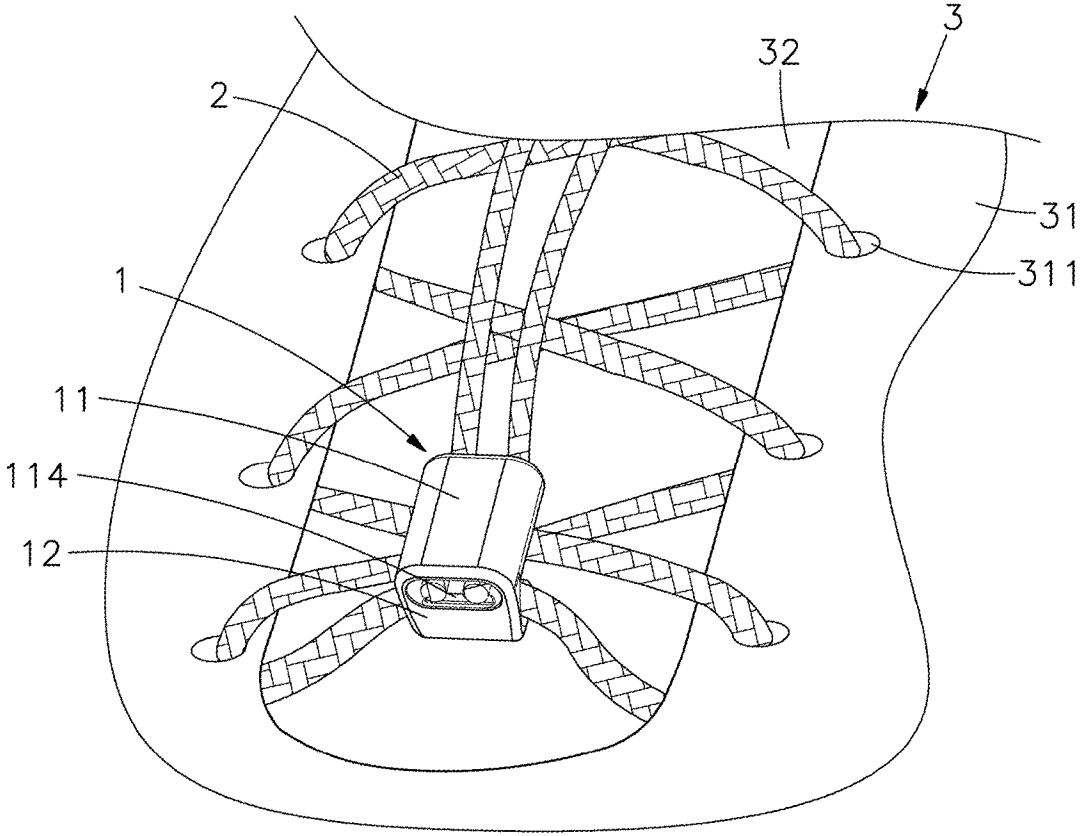
FIG. 7 is a schematic view of a usage status of a fastener of the present disclosure.

Please refer to FIGS. 4 through 7, which are first, second and third sectional side views of the fastener of the present disclosure assembled with the rope, and the schematic view of the usage status of the fastener of the present disclosure. In this embodiment, the rope tail positioning fastener of the present disclosure is applied to a shoe body 3, but the present disclosure is not limited thereto. In actual application, the rope tail positioning fastener of the present disclosure can be applicable to clothes (such as garment, or overcoat), a bag (such as backpack or handbag), or other object which can be fastened by using the rope 2. The shoe body 3 includes a tongue part 32 formed at a vamp 31 thereof, and a plurality of eyelets 311 formed on two opposite sides of the vamp 31 corresponding in position to the tongue part 32 and arranged alongside. Tail parts 21 of two ends of the rope 2 are inserted into the eyelets 311 of the vamp 31 in sequential order. Next, the tail parts 21 of the two ends of the rope 2 are inserted into the through holes 111 of the base 11 respectively, and then out of the hole 113 at other side of the insertion channel 110 of the base 11, as shown in FIG. 4. After the tail parts 21 of the rope 2 is exposed out of the insertion channel 110, the two tail parts 21 are sewn by seam line to form a seam part 22, as shown in FIG. 5; and, after the seam part 22 is completed, the user can pull the rope 2 back to receive the two tail parts 21 and the seam part 22 of the rope 2 into the insertion channel 110 of the base 11, and not expose the two tail parts 21 and the seam part 22 out of the insertion channel 110, as shown in FIG. 6. The seam part 22 of the rope 2 can be stopped by the stop part 112 of the base 11, so the rope 2 can be held and positioned reliably inside the insertion channel 110 without loosening from or slipping out the fastener body 1 easily.

Next, the rope 2 adjacent to a side of the elastic arm 12 is then inserted into the opening 1201 formed between the base 11 and the hook part 121 of the elastic arm 12. The distance between the base 1 and the hook part 121 (that is, the size of the opening 1201) is shorter than an outer diameter of the rope 2, and the fastener body 1 is formed integrally by rubber or plastic, so when the rope 2 pushes the end portion of the hook part 121, the elastic arm 12 can be elastically deformed to extent outwardly, to make the opening 1201 larger. After the rope 2 is inserted into the receiving space 120, the elastic arm 12 is recovered elastically, so that the hook part 121 of the elastic arm 12 is able to prevent the rope 2 from departing from the stowing space 120. As a result, the rope tail positioning fastener of the present disclosure can prevent the rope 2 from shaking while the user is walking or doing exercise, thereby improve user's safety.

The two tail parts 21 of the rope 2 can be inserted into the insertion channel 110 through the through holes 111 of the base 11, and then exposed out of the hole 113 at the other side of the insertion channel 110; furthermore, each of the two tail parts 21 of the rope 2 is provided with the seam part 22 formed by seam line, so the user can pull back the rope 2 to receive and hide the seam part 22 and the two tail parts 21 of the rope 2 in the insertion channel 110 of the base 11, thereby making the entire shoe appear aesthetically appealing and fashionable. The two tail parts 21 of the rope 2 are combined and positioned with the fastener by the seam parts thereof, so the size of the fastener body 1 can be smaller and the material cost of the fastener of the present disclosure can be reduced, thereby making the fastener of the present disclosure more competitive.

Furthermore, the base 11 of the fastener body 1 of the present disclosure is provided with clamping blocks 114 protruded on the inside walls of the two opposite sides of the insertion channel 110, respectively. When the rope 2 is received in the insertion channel 110, the rope 2 can be clamped by the two clamping blocks 114, so that the tail parts 21 of the rope 2 can be reliably positioned and hidden inside the insertion channel 110 without being exposed out of the insertion channel 110. As a result, while the user is walking or doing exercise, the tail part 21 of the rope 2 is not easy to slip out of the insertion channel 110 to swing freely, thereby preventing the user from stumble or accident due to the rope 2 being stepped by the user or hooked by other object, and further ensuring the user's safety.

The above-mentioned embodiment is an example for illustration, and the present disclosure is not limited thereto. The main concept of the present disclosure is that the fastener body 1 is provided with the insertion channel 110 formed inside the base 11, and the two through holes 111 are formed at and cut through the side of the insertion channel 110, and the stop part 112 is formed between the two through holes 111. The hole 113 is located at and cut through the other side of the insertion channel 110, and the side of the base 11 adjacent to the hole 113 is bent and extended to form the elastic arm 12 suspended relative to the base 11; and, the rope 2 can be received in the insertion channel 110, and the two tail parts 21 of the rope 2 can be sewn to form the seam part 22 to be stopped at the stop part 112, so that the two tail parts 21 of the rope 2 can be positioned by the seam parts 22. As a result, the fastener body 1 can have smaller volume, thereby reducing the material cost of the fastener.

The present disclosure disclosed herein has been described by means of specific embodiments. However, numerous modifications, variations and enhancements can be made thereto by those skilled in the art without departing from the spirit and scope of the disclosure set forth in the claims.

What is claimed is:

1. A rope tail positioning fastener comprising a fastener body, wherein the fastener body comprises a base and an elastic arm, the base is provided with an insertion channel formed inside and configured for insertion of at least one preset rope, and the insertion channel is formed with two through holes cut through a side thereof and configured for insertion of two tail parts of the at least one preset rope, and a stop part formed between the two through holes, and a hole cut through other side thereof and configured to expose out the two tail parts, and a side of the base adjacent to the hole is bent and extended to from the elastic arm suspended under the base;

wherein when the two tail parts are exposed out of the hole, the two tail parts is sewn to form a seam part, so that the seam part of the two tail parts is stopped and positioned by the stop part when the preset rope is received in the insertion channel, wherein the insertion channel of the base is provided with two clamping blocks respectively protruded on inside walls of two opposite sides thereof and adjacent to the hole, and configured to clamp the at least one preset rope.

2. The rope tail positioning fastener according to claim 1, wherein the fastener body is made integrally by elastic material including rubber or plastic.

3. The rope tail positioning fastener according to claim 1, wherein the elastic arm of the fastener body is provide with a hook part formed at an end portion thereof and facing towards the base, and a receiving space is formed between the base and an inner side of the elastic arm and configured to receive the preset rope, and an opening is formed between the base and the end portion of the hook part, and a distance between the opening and the base is shorter than an outer diameter of the at least one preset rope.

* * * * *